United States Patent [19]

Lewis

[11] 4,425,072

[45] Jan. 10, 1984

[54] MATERIAL HANDLING EQUIPMENT EXTENSION APPARATUS FOR WRECKING AND THE LIKE

[75] Inventor: Daniel D. Lewis, Hudson Falls, N.Y.

[73] Assignee: Efficiency Production, Inc., Lansing, Mich.

[21] Appl. No.: 245,932

[22] Filed: Mar. 20, 1981

[51] Int. Cl.[3] ..... B66C 23/36

[52] U.S. Cl. ..... 414/724; 37/117.5; 37/DIG. 3; 172/253

[58] Field of Search ..... 414/607, 724, 722; 172/253, 250, 246; 37/117.5, DIG. 3; 173/139; 299/94, 69, 70, 37; 294/78 R, 82 R; 254/325, 326, 333, 334, 335

[56] References Cited

U.S. PATENT DOCUMENTS

| | | | |
|---|---|---|---|
| 1,739,938 | 12/1929 | Barnett | 254/334 |
| 2,433,584 | 12/1947 | Turner | 414/607 |
| 3,207,347 | 9/1965 | Ehrlich | 414/607 |
| 3,586,112 | 6/1971 | Kelley | 173/29 |
| 3,587,887 | 6/1971 | De Carli | 414/724 X |
| 3,658,384 | 4/1972 | Gluszek | 299/37 |
| 3,807,802 | 4/1974 | Betters | 37/117.5 X |
| 4,172,687 | 10/1979 | Schultz | 414/724 |
| 4,200,423 | 4/1980 | Sornsin | 414/724 |
| 4,268,213 | 5/1981 | Obbink | 414/563 |
| 4,315,550 | 2/1982 | Fulkerson et al. | 173/139 X |
| 4,329,103 | 5/1982 | Miller | 414/724 X |

*Primary Examiner*—Leslie J. Paperner
*Assistant Examiner*—Donald W. Underwood
*Attorney, Agent, or Firm*—Paul I. Edelson

[57] ABSTRACT

Apparatus for use in conjunction with material handling equipment having a pivotable working member, and comprising cooperatively lever acting extension members attached to opposite sides of the pivotable working member of the material handling equipment is disclosed. One extension member is flexible, and the other is rigid. The rigid extension member is attached to the equipment working member through a hinge mechanism. The hinging of the rigid extension member, in combination with the flexibility of the other extension member, protects the material handling equipment from damage by large mechanical impulses to which the extension apparatus may be subjected in use. An extension apparatus working member is attached to the rigid extension member. In one embodiment, the extension apparatus working member includes a wrecking member, such as a wrecking ball. In other embodiments, the extension apparatus working member may be a hook, tongs, a magnet, a splitting wedge, or the like.

19 Claims, 6 Drawing Figures

MATERIAL HANDLING EQUIPMENT EXTENSION APPARATUS FOR WRECKING AND THE LIKE

This invention relates to material handling equipment. More particularly, this invention relates to leveraged extension apparatus connected to, and operated by, a pivotable working member of material handling equipment, such as a bucket, whereby the rotational motion of the equipment working member is converted to a magnified translational motion of a working member associated with the extension apparatus, for example, a wrecking ball, tongs, a magnet, a splitting wedge, or the like.

Material handling equipment items, such as bulldozers, front-end loaders, and backhoes, typically comprise tractors having arms known as booms (and in the case of backhoes, dippersticks also) adapted to be moved vertically by hydraulic means. At the end of the arm or arms furthest from the tractor, a working member, typically a bucket, is so attached to be rotatably, or pivotably, movable, again by hydraulic means. In the typical, design intended, operation of these machines, the rotational motion of the working member is employed to perform a digging or scooping function.

It is a first object of this invention to provide extension apparatus for attachment to the working member of an item of material handling equipment to make use of the rotational motion of said working member, by means of a lever arrangement included within the extension apparatus of this invention, to convert the rotational motion of said working member into a translational motion of an easily variable velocity.

In the prior art, it has been known to utilize material handling equipment of the sort described hereinabove to perform functions other than the design intended digging or scooping functions, both with and without modification to the equipment. For example, in light demolition tasks, it has been known to directly use a backhoe bucket as a wrecking ram. This is not desirable since it exposes the material handling equipment to risk of serious damage by subjecting it to mechanical impulses or shock loadings far in excess of those encountered in normal operation of the equipment for its intended function, and in excess of the shocks which the equipment is designed to withstand. Additionally, only the very lightest demolition tasks can even be attempted in this manner. The prior art also includes the attachment of ripping teeth, and other such specially hardened working tool attachments, to material handling equipment buckets to improve the utility of such equipment for wrecking and related tasks. These measures, while somewhat effective, are limited to improving the utility of the immediate working edge, but do nothing to protect the remainder of the equipment from damage by transmitted impulses. Another technique known to the prior art for using backhoes for light demolition work involves the removal of the bucket from the end of the dipperstick and attaching a pneumatic or hydraulic jack-hammer in its place. The utility of this technique is limited to backhoes since the articulation between the boom and dipperstick is needed to enable sufficient flexibility in the positioning of the jack-hammer attachment to effectively demolish a variety of structures. This technique suffers from two disadvantages: firstly, the jack-hammer attachment only partially isolates the backhoe from potentially damaging impulses; secondly, the jack-hammer attachment is very expensive. There is, of course, a machine designed specifically for the performance of demolition tasks: the wrecking crane. The reason that attempts have been made in the prior art to use material handling equipment for light demolition is that wrecking cranes are very expensive, and have little, if any, utility for tasks other than demolition. With this impetus, the prior art has made some attempts to solve the problems outlined hereinabove. Each of these prior attempts, while useful, exhibits its own disadvantages. One such attempt is described by Kelley in U.S. Pat. No. 3,586,112. Kelley provides a complete machine, including an internal combustion engine, and windlasses driven thereby, constructed upon a frame adapted to supportingly mount the entire machine within the bucket of a front-end loader. The machine also includes a wrecking ball which is supported by pulley arrangements attached to struts extending from the frame such that the wrecking ball may be moved either vertically, or pendulously, by operation of a motor-driven windlass. Kelley's apparatus is obviously very expensive and cumbersome, and is limited in its operational capability by the limitation in height to which the booms of the front-end loader can raise the bucket. Another prior art attempt is shown by Gluszek in U.S. Pat. No. 3,658,384. Gluszek provides a leveraged arrangement of first and second scissors arms attached respectively to the upper and lower rims of a front-end loader bucket. A first end of a shaft is attached to Gluszek's apparatus at the junction of the first and second scissors arms. The second end of the shaft carries a wrecking pick member. Each of the three longitudinal members in Gluszek is rigid. In accordance with the teachings of Gluszek, rotation of the front-end loader bucket is translated through the lever arrangement into vertical motion of the wrecking pick of sufficient magnitude and speed to be useful in wrecking small buildings. The Gluszek apparatus is limited in utility by being operable only in the vertical plane, being limited to the demolition of small structures, and, most seriously, by seriously risking damage to the front-end loader by direct transmission of very large mechanical impulses to the front end loader through the rigid members comprising the apparatus.

It is also known in the prior art to adapt material handling equipment, particularly backhoes, for the performance of functions other than digging by attaching an auxiliary tool to the bucket. Examples of these attachments include the ripping teeth hereinabove mentioned, the commonly used side-cutters, the grasping tool comonly known by its trade name "Big Thumb," and lifting hooks of various sorts.

In view of the foregoing, it is principal object of this invention to provide extension apparatus for use with material handling equipment having a pivotable working member wherein said extension apparatus comprises a lever machine having two arms connected across said pivotable member and meeting to form a fulcrum in substantially spaced relation to said pivotable member, and wherein said extension apparatus is provided with means to carry a tool.

It is a further object of this invention to provide such apparatus for the performance of a variety of functions by changing the tool which is carried by said extension apparatus.

It is another object of this invention to provide such extension apparatus to enable said material handling equipment to be useful in the wrecking of structures, and wherein said tool is a wrecking ball.

It is another object of this invention to provide such extension apparatus which is easily transportable and easily attached to, and detached from, an item of material handling equipment.

Another object of this invention is to provide such apparatus in which the effective length of the lever arms is adjustable.

Another object of this invention is to provide such apparatus in which the tool may be attached at various points along one of the lever arms so that, by selection of the tool attachment point, and adjustment of the effective length of the lever arms, the available torque from the material handling equipment item may be matched to the task to be performed.

It is another object of this invention to provide such apparatus in which the lever arms are so constructed and configured to provide protection for the extension apparatus from damage by shock in the use of said apparatus in wrecking operations, and to isolate the material handling equipment item from such shocks completely enough to eliminate any risk of damage to the material handling equipment item.

It is another object of this invention to provide such extension apparatus wherein the means for attaching the extension apparatus to the material handling equipment item is dimensionally adjustable to facilitate the attachment of the extension apparatus to different items of material handling equipment.

Yet another object of this invention is to provide such extension apparatus which is inexpensive to manufacture and simple and inexpensive to install on material handling equipment items of various types and manufactures.

Briefly, and in accordance with one embodiment of this invention, extension apparatus for attachment to a pivotable working member of an item of material handling equipment comprises a rigid boom member for attachment to a lower edge of the pivotable working member through a hinge mechanism permitting deflection of the rigid boom member in the vertical plane about the hinge pin of said hinge mechanism, and a flexible member attached to an upper edge of said pivotable working member, said rigid boom member and said flexible member being connected together at a point substantially spaced from said pivotable working member to create, at said point of attachment, a fulcrum for a lever machine operated by rotation of said pivotable working member. The rigid boom member is provided with at least one means for attaching a tool thereto. The flexible member is provided with means for adjusting the length thereof. In some embodiments, the rigid boom member is provided with a plurality of means, disposed along the length thereof for attachment of the flexible member, and a plurality of means, disposed along the length thereof, for attachment of a tool. In another embodiment of this invention, the rigid boom member comprises two members dimensioned to telescopingly fit together, and means for immobilizing one telescoping element within the other, to provide a rigid boom member of variable length.

The novel features of this invention sought to be patented are set forth with particularity in the appended claims. The invention, together with further objects and advantages thereof, may be understood from a reading of the following specification and appended claims in view of the accompanying drawings in which:

FIG. 1 is a side elevation view of extension apparatus in accordance with one embodiment of this invention installed upon the bucket of a backhoe.

FIG. 2*a* is a view of the adjustable attachment strut structure.

FIG. 2 is a top plan view, showing the extension apparatus of this invention operatively installed on the bucket 10 of a backhoe.

Figure 1:
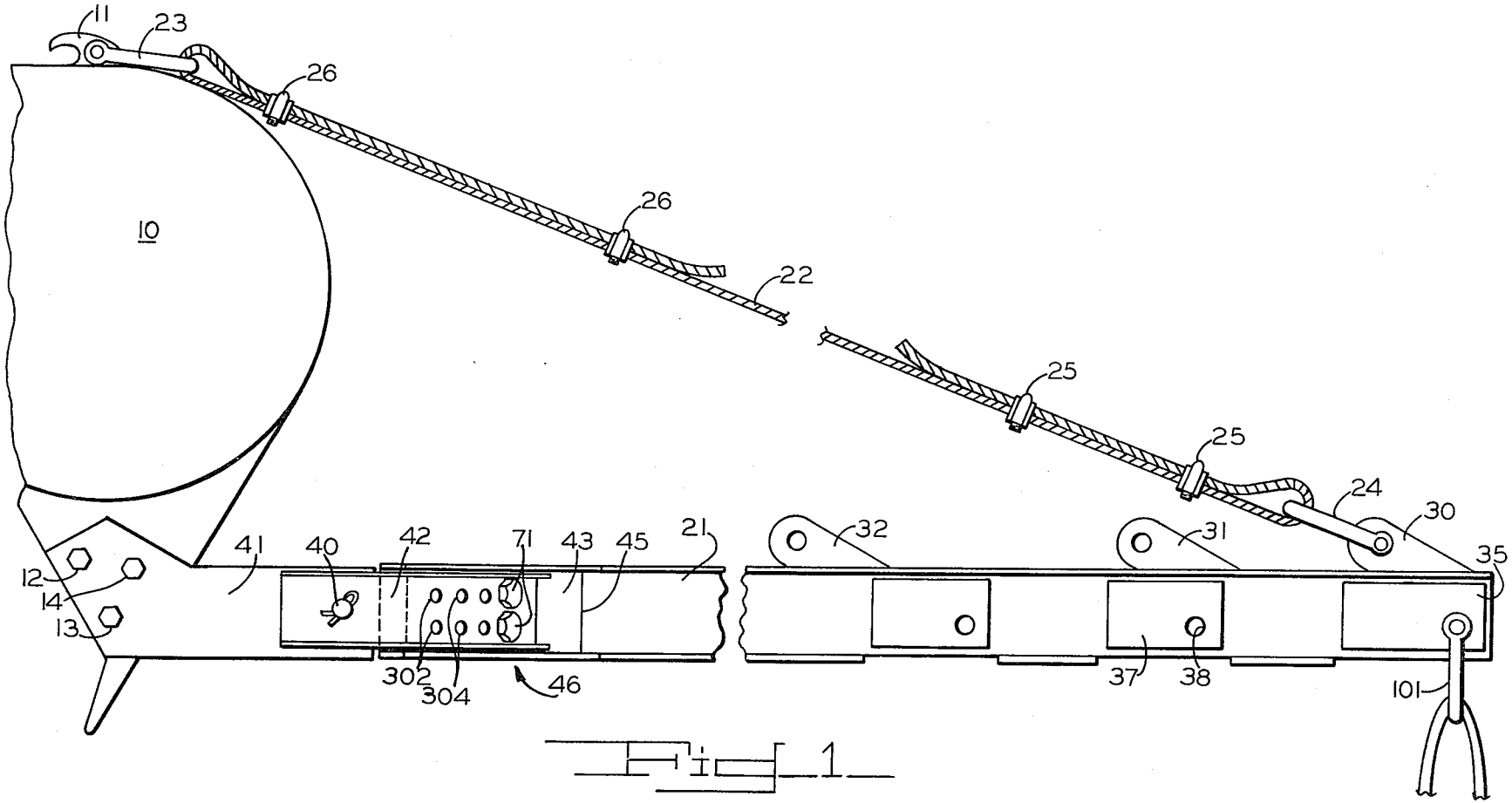
FIG. 1 is a side elevation view.

Backhoe buckets are typically equipped with a lifting hook, such as 11, shown on bucket 10, on a top surface thereof, and a pair of side cutters, attached respectively by bolts 12, 13, and 14, and 62, 63, and 64, on opposite vertical sides of bucket 10 adjacent the diametrically opposed, or bottom, surface of the bucket from the surface bearing lifting hook 11. In the preferred embodiment of this invention, the extension apparatus is simply and easily installed on a backhoe bucket bucket by removing bolts 12, 13, 14, 62, 63 and 64, thus freeing the side cutters, removing the side cutters, and installing mounting plates 41 and 51 in place of the side cutters, affixing them by reinserting the bolts. This provides for installation of the rigid boom member, 21, of the extension apparatus of this invention, as more particularly hereinafter described. Similarly, existing lifting hook 11 is used to attach flexible member 22 of the extension apparatus of this invention to bucket 10 through clevis 23. It may thus be seen, at the outset, that the above-recited object of this invention to provide extension apparatus which may be quickly and easily mounted upon, and demounted from, material handling equipment, has been achieved.

Figures 2, 2A, 5:
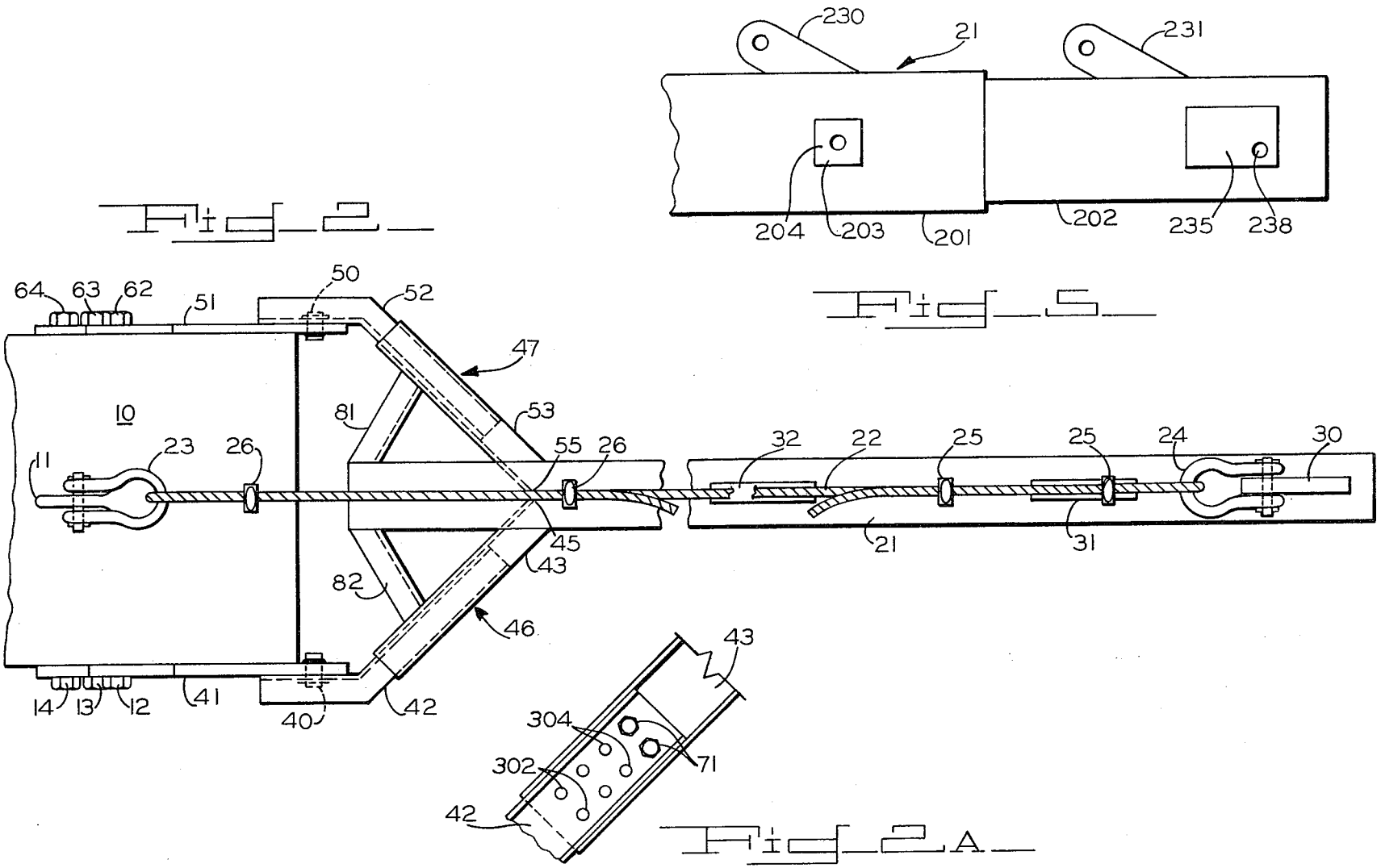
FIG. 2 is a top plan view of the apparatus of FIG. 1.
FIG. 5 is a side elevation view of an alternative boom member for use in the apparatus of this invention in which the boom member comprises telescoping box beams to provide a boom member of variable length with means for preventing relative motion between the box beam members to fix the length of the boom at the desired length for a given operation.

The extension apparatus of this invention, in one embodiment, may be seen by reference to FIGS. 1 and 2, to comprise a rigid boom member, 21, which may advantageously be a steel 'I' beam, and a flexible member, 22, which may advantageously be a steel cable. In view of the intended uses of the extension apparatus of this invention, rigid boom 21 may conveniently be between 8 and 15 feet in length. In the embodiment of this invention actually reduced to practice, the boom member, 21, was formed of a section of 0.65 foot by 0.65 foot steel 'I' beam of 11.2 feet in length. The stated range of boom lengths is functionally convenient, but this invention is not so limited, and the statement is made for the guidance of those skilled in the art in making and using this invention only. Similarly, in the embodiment actually reduced to practice, flexible member 22 was formed of $\frac{3}{4}$ inch steel cable. The precise selection of elements, and their dimensions, are matters of choice to those skilled in the art. The particular example of the embodiment actually reduced to practice is given for guidance. The principal intended use of the embodiment actually reduced to practice is for wrecking, and the elements described in the example are fully adequate to handle a wrecking ball in all operative modes. It will be apparent to those skilled in the art that if an embodiment of apparatus in accordance with this invention is constructed for use exclusively in lighter tasks than wrecking, less substantial elements may be advantageously employed.

Figure 3:
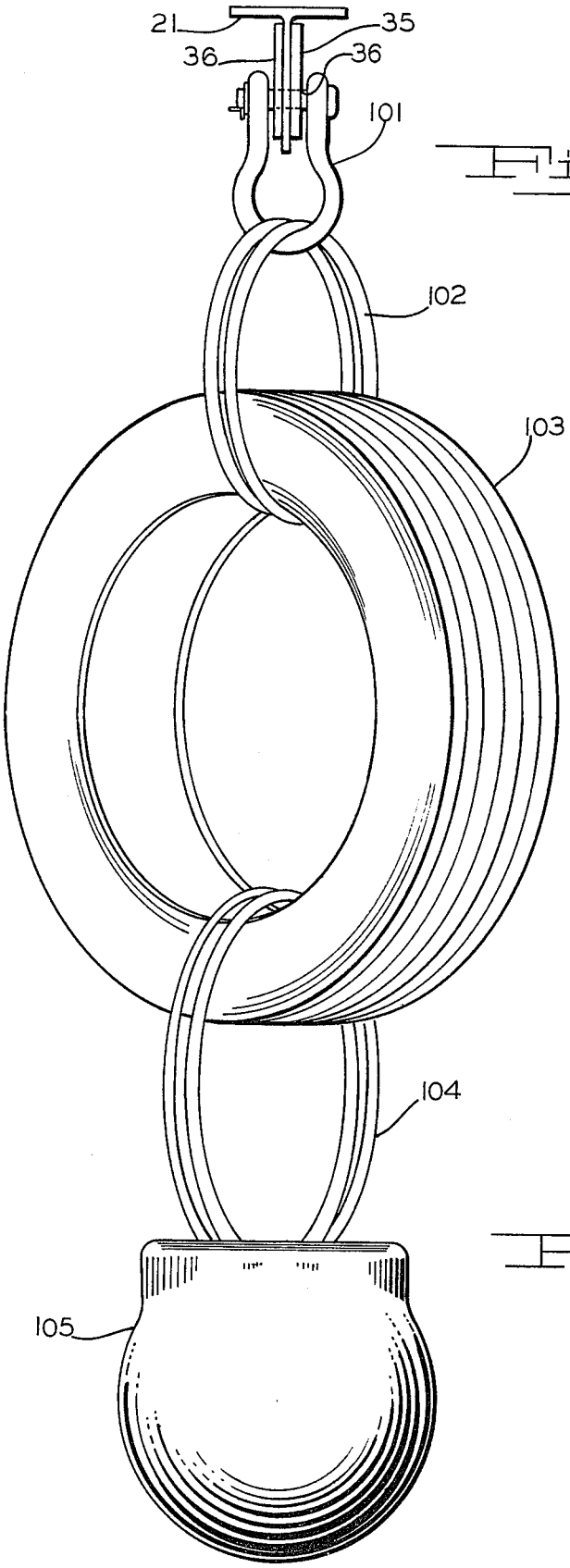
FIG. 3 is an elevation view of a tool member for attachment to the extension apparatus of FIGS. 1 and 2 in accordance with an embodiment of this invention in which the tool member is a wrecking ball.
Figure 4:
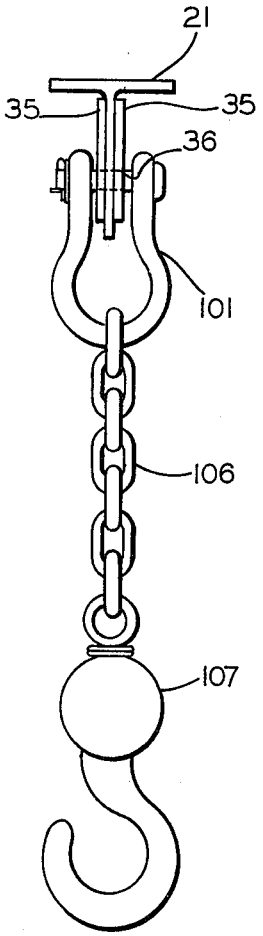
FIG. 4 is an elevation view of an alternative tool member for attachment to extension apparatus of this invention.

Flexible member 22 is adjustable in overall length by having opposite ends thereof secured respectively by cable clamps 26 and cable clamps 25. A first end of cable 22 is looped through clevis 23, and back on itself to be secured by cable clamps 26. Clevis 23 is then used to removably connect a first operative end of flexible member 22 to lifting hook 11 provided on bucket 10. The opposite end of cable 22 is looped through a second clevis, 24, and secured by cable clamps 25. Clevis 24 is used to connect the far end of flexible member 22 from hook 11 to fulcrum bracket 30 which is located on the upper surface of rigid beam member 21 proximately an end thereof. For a heavy duty embodiment of apparatus in accordance with this invention, such as that actually reduced to practice, fulcrum bracket 30 may conveniently be formed of one inch steel plate stock, and may conveniently be attached to the upper flange of beam 21, along the longitudinal center line thereof, by welding. Proximately the end of beam member 21 to which fulcrum bracket 30 is attached, a tool attachment hole 36 is provided in the web of beam member 21, by any convenient means, such as drilling or punching, to provide for the attachment to beam 21 of a depending tool. Tool attachment hole 36 is illustrated in FIGS. 3 and 4, but can not be seen in FIG. 1 because it is hidden behind clevis 101 installed therein for the purpose of attaching a tool. In the heavy duty embodiment of apparatus in accordance with this invention illustrated, and as actually reduced to practice, it is preferred to reinforce the web of beam member 21 in the vicinity of tool attachment hole 36 by reinforcing plates 35 on each side of the web. Reinforcing plates 35 may conveniently be formed of one inch steel sheet stock, and may be conveniently attached to the web of rigid boom member 21 by welding. Tool attachment hole 36, of course, penetrates the reinforcing plates 35 as well as the web of boom member 21. Returning the bucket 10, mounting plates 41 and 51 are attached thereto in place of the side cutters, as aforesaid. Mounting plates 41 and 51 are provided, respectively, with hinge pins 40 and 50. Hinge pins 40 and 50 may be provided upon their associated mounting plates by any convenient means known in the art, as, for example, by tapping holes in the mounting plates, threading one end of the hinge pins to mate with the tapped holes, screwing them in, and securing them with nut and lock washer, or may be cast integrally with the mounting plates, but most conveniently from operational and cost effectiveness considerations, hinge pins 40 and 50 are preferably welded to mounting plates 41 and 51 respectively. Rigid beam member 21 is attached to mounting plates 41 and 51 by attachment struts indicated generally at 46 and 47 so as to be pivotable about hinge pins 40 and 50. Attachment struts 46 and 47 may be unitary structures, if desired, but in the preferred embodiment of this invention, are adjustable attachment struts to facilitate the attachment of a single apparatus constructed in accordance with this invention to a variety of different buckets of differing widths. The following description is of the preferred adjustable attachment strut structure, but modification thereof to a unitary, fixed dimension, attachment strut structure will be obvious to those skilled in the art in view of the following structural description. Adjustable attachment strut 46 comprises members 42 and 43, which may conveniently be nesting channel stock members, but this invention is not so limited by specific geometry. Member 43 is preferably attached to the web of beam member 21 by welding. If desired, member 43 may also be welded to the flanges of beam member 21. Member 43 extends outwardly from beam 21 at an angle. The outwardly extending portion of member 43 has a plurality of holes, such as 62 and 64 therein. Member 42 is an angled member having a first portion parallel to, and preferably nesting within, member 43, and a second portion parallel to mounting plate 41. The second portion of member 42 has a hole therein adapted to receive hinge pin 40 to thereby pivotably attach the extension apparatus of this invention to bucket 10, as aforesaid. The portion of member 42 parallel to member 43 similarly has holes such as 302 and 304 therein, to provide for width adjustment of attachment strut 46 by selection of the appropriate holes in members 42 and 43 for alignment and securing by means such as bolts 71. Attachment strut 47, as shown in FIG. 2 is similarly constructed to attachment strut 46 as just described, pivotably attaching one arm of member 52 to hinge pin 50 and mating with member 53. Attachment means are similar to those described with respect to attachment strut 46, but are not illustrated since they are on the opposite, unseen, side of bucket 10 in FIG. 1. Obviously, nonadjustable attachment struts could be formed simply by extending members 42 and 52 to the web of boom 21 and welding them in place of members 43 and 53 as above described.

Rigid beam member 21 is supported in its desired position in the vertical plane by flexible member 22, as aforesaid. Flexible member 22 is adjusted in effective length by means of cable clamps 25 and 26 so that the desired position in the vertical plane is maintained by rigid boom member 21 when flexible cable member 22 is stretched tautly between clevis 23 attaching a first end of cable 22 to lifting hook 11, and clevis 24 attaching the second end of cable 22 to fulcrum bracket 30. It may thus be seen that rigid boom member 21 is free to pivot vertically about hinge pins 40 and 50, and is supported vertically only by the tension in flexible cable member 22. In operation, rotation of bucket 10 of the material handling equipment causes a tool attached to clevis 101 to be raised and lowered by the action of flexible cable 22 on rigid boom member 21 through fulcrum bracket 30. It may thus be seen, that another recited object of this invention has been achieved: That of isolating the material handling equipment from shock loadings which might be experienced by the extension apparatus. In the event that the extension apparatus contacts an object on a down swing of the extension apparatus, the shock is fully absorbed by the extension apparatus by rigid boom member 21 pivoting upwardly about hinge pins 40 and 50, together with a folding of flexible cable member 22.

The particular advantages of extension apparatus in accordance with this invention, particularly over the prior art as discussed hereinabove, may be best appreciated in the embodiment of this invention in which the extension apparatus is used to enable the material handling equipment to perform wrecking operations, and is best understood with reference to FIG. 3. FIG. 3 shows rigid boom member 21 in end elevation view with reinforcing plates 35 installed on opposite sides of the web member having hole 36 through the web member and the reinforcing plates and clevis 101 installed therein, all as shown also in FIG. 1. In this embodiment, tool member 105 is a wrecking ball. In the ebodiments of this invention which have actually been reduced to practice, up to three ton wrecking balls have been satisfactorily used with extension apparatus in accordance with this invention attached to the bucket of a backhoe. Wrecking ball 105 is attached to rigid boom member 21 through clevis 101, cables 102 and 104, with a shock absorbing means, such as tire 103, as is known in the art, or a chain, such as is also known in the art, between cables 102 and 104. In a wrecking operation, bucket 10 of the material handling equipment is rapidly rotated in opposite directions to thereby rapidly raise and lower the end of boom member 21 carrying wrecking ball 105. On the down-stroke, wrecking ball 105 is allowed to free-fall, thereby imparting maximum momentum against the structure to be demolished. In order to achieve the maximum momentum of free-fall, the extension apparatus must be moved very rapidly, and its downward motion should not be slowed in an attempt to prevent the transmission of shock to the material handling equipment. Therefore, since it cannot be known, on each down stroke, the amount of the structure to be demolished which will break under the impact of the ball, the achievement of free-fall velocity by the wrecking ball presents a risk that the end of the boom members supporting the ball will come in contact with the structure being demolished. In accordance with this invention, full advantage may be taken of free-fall by the wrecking ball since contact between boom member 21 and the structure being demolished will result only in the temporary folding of the extension apparatus of this invention about hinge pins 40 and 50 with a slackening of flexible cable member 22.

Additionally, in wrecking operations, the preferred embodiment of this invention, using a backhoe as the item of material handling equipment employed, provides for horizontal as well as vertical operation of the wrecking ball, 105. For horizontal operation, the boom of the backhoe is raised to a nearly vertical aspect, and the dipperstick is positioned to depend, also nearly vertically, forming an acute angle between the boom and dipperstick of the backhoe. The wrecking ball may then be caused to swing horizontally, in a pendulum fashion, either by rotation of the bucket, as hereinabove described, by motion of the dipperstick relative to the boom of the backhoe, as will be readily apparent to those familiar with backhoe operation, or by pivoting of the tractor member of the backhoe. The selection of means for imparting pendulous motion to a wrecking ball attached to extension apparatus in accordance with this invention as hereinabove described is a matter of choice which will be determined on the basis of the particular task to be performed.

In addition to the wrecking apparatus in accordance with this invention, as heretofore described, the extension apparatus of this invention is useful for a variety of functions in which it is desired to move a tool over a large distance, at operator selectable sppeds, with all of the available power of an item of material handling equipment. For example, splitting wedges may be used in a fashion directly analogous to the vertical operation of the wrecking ball as described hereinabove. Electromagnets may be suspended from clevis 101 for use in moving metallic material around scrap yards, and the like, again with any available item of material handling equipment, thereby eliminating the need for a separate crane, or a lifting hook, such as illustrated in FIG. 4, may be used for moving materials in containers and the like, again without the need for a crane. In FIG. 4 an end elevation view of rigid boom member 21, with associated reinforcement plates 35, and clevis 101 is again shown. Clevis 101, in FIG. 4, attaches a lifting hook, 107, to the extension apparatus of this invention through a chain, 106 and is known in the art.

In accordance with this invention, when lighter tasks are to be performed, a lighter boom member than the 'I' beam illustrated may be advantageously employed, and reinforcements plates such as 35 may be eliminated. Additionally, a longer boom than that specifically described for the heavy duty embodiment may be advantageously employed if desired.

Returning to FIG. 1, in accordance with another novel feature of this invention, boom member 21 may be provided with a plurality of fulcrum brackets, such as 31 and 32, in addition to fulcrum bracket 30, disposed along the length thereof, and a plurality of reinforcing plates and tool attachment holes such as, respectively, 37 and 38 disposed along the length thereof. Flexible cable member 22 may be attached through clevis 24 to any of the fulcrum brackets desired, and a tool may be depended from any of the tool attachement holes desired. This provides the ability to vary the leverage obtainable as, for example, increasing the leverage by attaching cable member 22 to fulcrum bracket 32 while depending a tool from tool attachment hole 38, or to increase the torque available by attaching cable member 22 to a fulcrum bracket located further along the length of boom member 21 than the tool attachment hole to which a tool is attached. In particular, this arrangement permits the optimum utilization of the available torque from the bucket member of the material handling equipment item employed.

In an alternative embodiment of this invention, rigid boom member 21 is itself adjustable in length. This alternative embodiment is illustrated in FIG. 5, wherein boom member 21 comprises telescopingly fitting box beam members 201 and 202. Either, or both, of the box beam members may be provided with a fulcrum bracket welded on the upper surface thereof, such as 230 and 231. Box beam member 201 is provided with a threaded plate 203 containing a threaded hole through plate 203 overlying a hole in box beam 201 adapted to receive bolt 204. In operation bolt 204 is loosened and box beam member 202 is slid within box beam member 201 until the desired length of boom member 21 is achieved. Then bolt 204 is driven through threaded plate 203 until it forceably contacts box beam member 202 to secure it in latteral position within member 201. Box beam member 202 is provided with a reinforcing plate 235 proximately the free end thereof, and has tool mounting hole 238 through the reinforcing plate and box beam member similar to the structures discussed hereinabove with respect to the 'I' beam member. Box beam member 201 is attached through mounting bracket structures identical to 46 and 56 as discussed hereinabove to a bucket and functions similarly to the apparatus hereinabove described.

While this invention has been described with reference to particular embodiment and examples, other variation and modifications will occur to those skilled in the art in view of the above teachings. Accordingly, it should be understood that, within the scope of the appended claims, the invention may be practiced otherwise than specifically described.

The invention claimed is:

1. Wrecking apparatus for use with material handling equipment, said material handling equipment having a pivotable working member, comprising:
a rigid boom member;
a flexible member;
means for attaching a first end of said flexible member to said pivotable working member proximately a first lip of said pivotable working member;
first and second hinge means for pivotably attaching a first end of said boom member to said pivotable working member proximately a second lip of said pivotable working member;
means for attaching a second end of said flexible member to said boom member proximately a second end of said boom member;
a massive wrecking ball member; and
means for attaching said massive wrecking ball member to said boom member proximately said second end of said boom member; and wherein said pivotable working member is a hydraulicly driven bucket.

2. Extension apparatus for use with material handling equipment, said material handling equipment having a pivotable working member, comprising:
a rigid boom member;
a flexible member;
means for attaching a first end of said flexible member to said pivotable working member proximately a first lip of said pivotable working member;
first and second hinge means for pivotably attaching a first end of said boom member to said pivotable working member proximately a second lip of said pivotable working member said first and second hinge means being disposed respectively on first and second sides of said pivotable working member;
means for attaching a second end of said flexible member to said boom member proximately a second end of said boom member;
a depending working member; and
means for attaching said depending working member to said boom member proximately said second end of said boom member; and wherein said pivotable working member is a hydraulicly driven bucket.

3. Extension apparatus as claimed in claim 2 wherein said flexible member is a steel cable.

4. The apparatus of claim 3 wherein said means for attaching a first end of said flexible member more particularly comprises:
a clevis attached through a hole in a lifting hook disposed on said pivotable bucket working member;
a loop in said first end of said steel cable passing through said clevis; and
at least one cable clamp securing said first end of said steel cable in said loop.

5. The apparatus of claim 3 wherein said means for attaching a second end of said flexible member comprises:
a fulcrum bracket attached to an upper surface of said rigid boom member, said fulcrum bracket having a hole therein;
a clevis attached to said fulcrum bracket through said hole; and
at least one cable clamp securing said second end of said steel cable in said loop.

6. The apparatus of claim 5 including additionally a plurality of said fulcrum brackets attached along said upper surface of said rigid boom member in substantially spaced relation to each other.

7. Extension apparatus as claimed in claim 2 wherein said hinge means more particularly comprises:
first and second mounting plates rigidly attached to said pivotable bucket working member, each said mounting plate having a portion thereof extending beyond said pivotable working member, and having a hinge pin extending through said portion; and
first and second angled attachment strut members pivotably attached respectively to said first and second mounting plates at said hinge pins at one end thereof, and being afixed to said first end of said boom member at an opposite end of each said angled attachment strut member.

8. The apparatus of the claim 7 further including removable means for detachably attaching said one end of said angled attachment struts to said hinge pins.

9. The apparatus of claim 8 wherein each said angled attachment strut more particularly comprises:
a first member attached to said rigid boom member at an angle forming a small interior angle toward said first end of said boom member and a larger exterior angle toward said second end of said boom member, said first member having a plurality of holes disposed in spaced relation therein;
a second member having first and second portions disposed in an angled relationship to each other forming an interior angle between said first and second portions equal to said exterior angle formed between said first member and said rigid boom member said first portion having a hole therein for receiving one of said hinge pins, said second portion having a plurality of holes in spaced relation therein;
said first and second members being configured to mate together in mutual slidable relationship, whereby said holes in said first member and said holes in said second portion of said second member may be brought into a plurality of mutually aligned positions; and
means for affixing said first member to said second member through said aligned holes.

10. Apparatus as claimed in claim 2 wherein said means for attaching said depending working member comprises:
a hole in said rigid boom member;
a clevis installed through said hole in said rigid boom member; and
a second flexible member having a first end attached to said clevis, and a second end attached to said working member.

11. The apparatus of claim 10 wherein said second flexible member comprises a chain.

12. The apparatus of claim 10 wherein said second flexible member comprises first and second steel cables.

13. The apparatus of claim 12 further including shock absorbing means disposed between said first and second steel cables.

14. The apparatus of claim 10 wherein said means for attaching said depending working member further comprises at least one reinforcing plate attached to said rigid boom member and having a hole therein co-linear with said hole in said rigid boom member.

15. The apparatus of claim 10 wherein said depending working member is a wrecking ball.

16. The apparatus of claim 10 wherein said depending working member is a lifting hook.

17. Extension apparatus as claimed in claim 2 wherein said rigid boom member comprises first and second members, said second member being slidably receivable within said first member, and having means for attaching said depending working member proximately an end of said second member; and a fulcrum bracket attached to an upper surface of said second member proximately said means for attaching said depending working member.

18. The apparatus of claim 11 further including a fulcrum bracket attached to an upper surface of said first member.

19. The apparatus of claim 17 further including means for securing said second member within said first member at a desired longitudinal position.

* * * * *